US012571220B2

(12) United States Patent
Richards

(10) Patent No.: US 12,571,220 B2
(45) Date of Patent: Mar. 10, 2026

(54) CONNECTOR FOR A MODULAR DECKING SYSTEM AND A MODULAR DECKING SYSTEM COMPRISING THE SAME

(71) Applicant: NONONSENSE (GROUP) LTD, Colyton (GB)

(72) Inventor: Stephen James Richards, Lynton (GB)

(73) Assignee: NONONSENSE (GROUP) LTD, Colyton (GB)

( * ) Notice: Subject to any disclaimer, the term of this patent is extended or adjusted under 35 U.S.C. 154(b) by 1161 days.

(21) Appl. No.: 17/602,599

(22) PCT Filed: Apr. 8, 2020

(86) PCT No.: PCT/GB2020/050914

§ 371 (c)(1),
(2) Date: Oct. 8, 2021

(87) PCT Pub. No.: WO2020/208351

PCT Pub. Date: Oct. 15, 2020

(65) Prior Publication Data

US 2022/0213701 A1 Jul. 7, 2022

(30) Foreign Application Priority Data

Apr. 9, 2019 (GB) ..... 1905016

(51) Int. Cl.
*E04G 7/22* (2006.01)
*E04G 7/28* (2006.01)
(Continued)

(52) U.S. Cl.
CPC ..... *E04G 7/22* (2013.01); *E04G 7/28* (2013.01); *E04G 7/307* (2013.01); *E04G 7/34* (2013.01); *E04H 3/24* (2013.01)

(58) Field of Classification Search
CPC .. E04G 7/22; E04G 7/28; E04G 7/307; E04G 7/34; E04H 3/24; G06F 1/26
(Continued)

(56) References Cited

U.S. PATENT DOCUMENTS 3,239,188 A * 3/1966 Gostling ..... E04G 11/38 52/261
3,614,048 A * 10/1971 Young ..... B28B 7/0032 249/210

(Continued)

FOREIGN PATENT DOCUMENTS

CN 101892740 11/2010
CN 104763717 7/2015

(Continued)

OTHER PUBLICATIONS

International Search Report for corresponding PCT application No. PCT/GB2020/050914 mailed Jul. 15, 2020.

(Continued)

*Primary Examiner* — Muhammad Ijaz
(74) *Attorney, Agent, or Firm* — Notaro, Michalos & Zaccaria P.C.

(57) ABSTRACT

A modular decking system comprising a decking panel, a plurality of vertical supports, at least two first horizontal supports, at least two second horizontal supports arranged perpendicular to the first horizontal supports, one or more third horizontal supports arranged between the first horizontal supports and parallel to the second horizontal supports, and a plurality of connectors for detachably coupling the first and second horizontal supports, is disclosed. The connectors include an elongate tube adapted for insertion into the vertical supports and a connection hub. The connection hub and the ends of the first and second horizontal supports include reciprocating formations to enable the respective (Continued)

ends of the first and second horizontal supports to slidingly engage with the connection hub.

15 Claims, 10 Drawing Sheets

(51) Int. Cl.
*E04G 7/30* (2006.01)
*E04G 7/34* (2006.01)
*E04H 3/24* (2006.01)

(58) Field of Classification Search
USPC ..... 182/87, 106, 112, 113, 128
See application file for complete search history.

(56) References Cited

U.S. PATENT DOCUMENTS 4,340,130 A * 7/1982 Payne ..... E04G 1/154 182/119
4,587,786 A * 5/1986 Woods ..... E04G 7/307
5,000,290 A * 3/1991 Seely ..... E04G 7/28 182/119
5,961,240 A * 10/1999 Bobrovniczky ..... E04G 7/307 182/186.8
6,322,277 B1 * 11/2001 Jennings ..... E04G 11/48 403/174
6,505,453 B1 * 1/2003 Rixen ..... F16B 7/0446 403/255
6,557,666 B1 * 5/2003 Drouin ..... E04G 21/32 182/178.1
D747,459 S * 1/2016 Sonderegger ..... D24/111
11,181,224 B2 * 11/2021 Ho ..... F16M 11/046
11,719,006 B2 * 8/2023 McCracken ..... E04G 7/303 249/188
2003/0082986 A1 * 5/2003 Wiens ..... A63H 33/062 446/120
2004/0120759 A1 6/2004 Altman
2004/0211624 A1 * 10/2004 Wallther ..... E04G 7/307 182/186.7
2005/0189173 A1 * 9/2005 Becker ..... E04G 5/141 182/113
2006/0165482 A1 7/2006 Olberding
2007/0274771 A1 * 11/2007 Chang ..... E04G 11/48 403/187
2007/0278041 A1 * 12/2007 Cosgrove ..... E04G 5/14 182/113
2010/0078263 A1 * 4/2010 Kreller ..... E04G 1/14 182/113
2010/0078264 A1 * 4/2010 Kreller ..... E04G 7/28 182/113
2011/0079464 A1 * 4/2011 Phillips ..... E04H 3/24 182/113
2011/0203204 A1 * 8/2011 Messier ..... E04H 3/24 52/272
2011/0262215 A1 * 10/2011 Thacker ..... E04G 7/307 403/81
2014/0262619 A1 * 9/2014 Bains ..... E04G 7/34 248/351
2015/0023726 A1 * 1/2015 Thacker ..... E04G 7/32 403/49
2015/0034421 A1 * 2/2015 Watson ..... E04G 7/28 182/223
2016/0160513 A1 * 6/2016 Singh ..... E04G 1/152 182/113
2019/0390470 A1 * 12/2019 Rogers ..... E04G 7/32
2022/0213701 A1 * 7/2022 Richards ..... E04G 7/34
2023/0235580 A1 * 7/2023 Smith ..... E04G 5/142 182/113
2024/0003147 A1 * 1/2024 Mccarthy ..... E04G 21/3261
2024/0052648 A1 * 2/2024 Ono ..... E04G 7/02
2025/0003242 A1 * 1/2025 Haeberle ..... E04G 7/32

FOREIGN PATENT DOCUMENTS

DE 3617020 11/1987
EP 0126657 11/1984
EP 2305922 10/2010
FR 2679585 7/1991
WO 2009147004 12/2009
WO 2018186756 10/2018

OTHER PUBLICATIONS

European Search Report for corresponding United Kingdom application No. GB1905016.0 mailed Jun. 19, 2019.

* cited by examiner

CONNECTOR FOR A MODULAR DECKING SYSTEM AND A MODULAR DECKING SYSTEM COMPRISING THE SAME

TECHNICAL FIELD OF THE INVENTION

The present invention relates to a connector for a modular decking system, to a modular decking system comprising the connector and to a method of assembling a modular decking system using the connector.

BACKGROUND TO THE INVENTION

Modular decking systems are typically used in the construction of temporary or permanent structures such a stages for musicians, actors and other live performers. Modular decking systems generally comprise a plurality of vertical and horizontal supports which are arranged and connected at their respective ends to produce a frame that is capable of supporting a plurality of decking panels. The ends of the vertical and horizontal supports are typically connected by suitable fastening means, e.g. a clamp on bracket connection, a socket to bracket connection or a pin to bracket connection, meaning skilled or trained personnel are required to assemble such modular decking systems with appropriate tools. Moreover, the use of such fastening means to connect the vertical and horizontal supports limits the loads that can be applied at these connection points, which is undesirable. Most modular decking systems are often used in conjunction with a scaffolding sub-structure to achieve the desired stage height. However, a problem with known scaffolding systems is that they have a tendency to deflect when placed under high loads. This not only reduces the stability of the modular decking system, but also hinders the assembly of structures being built on the decking since it becomes increasingly difficult to align and connect the structures together.

It is an object of the embodiments of the present invention to provide a modular decking system that can be assembled without using tools and by installers with limited labour skills.

It is another object of embodiments of the present invention to provide a modular decking system that is less susceptible to deflection.

It is also an object of embodiments of the present invention to provide a modular decking system that is able to withstand greater loads.

SUMMARY OF THE INVENTION

According to a first aspect of the invention there is provided a modular decking system comprising:

- a decking panel;
- a plurality of vertical supports;
- at least two first horizontal supports;
- at least two second horizontal supports arranged perpendicular to the first horizontal supports;
- one or more third horizontal supports arranged between the first horizontal supports and parallel to the second horizontal supports, and
- a plurality of connectors for detachably coupling the first and second horizontal supports, the connectors comprising an elongate tube adapted for insertion into the vertical supports and a connection hub, wherein the connection hub and the ends of the first and second horizontal supports comprise reciprocating formations to enable the respective ends of the first and second horizontal supports to slidingly engage with the connection hub.

The modular decking system according to the first aspect of the invention enables a stage or decked flooring system to be erected over a varied topographical ground condition & substrate type, whilst maintaining complete structural integrity (irrespective of height) over side sway and support of both vertical & lateral loading, whilst maintaining a flat horizontal working platform. Moreover, the design of the components and the way in which they are secured together permits the use of local unskilled labour with minimum supervision, meaning the modular decking system can be erected easily, quickly and at reduced cost relative to conventional decking systems.

The connection hub formations may be formed around the elongate tube. In some embodiments, the connection hub formations may be welded to the elongate tube. The connector may be adapted for insertion into a vertical support of a scaffolding sub-structure. In addition to connecting the first and second horizontal supports together, the connection hub is configured to gather loads from the first and second horizontal supports and distribute them to the ground in a very efficient manner. This in turn allows the system to achieve very high decking loads.

The connection hub may comprise a base plate and a top plate. The provision of the base plate and top plate increased the rigidity and overall strength of the connection hub. In use, the reciprocating ends of the first and second horizontal supports rest on and are supported by the base plate. The top plate and the base plate may be configured to fit around the elongate tube.

The elongate tube may extend through and protrude beyond the top plate. In particular, the elongate tube extends beyond an upper surface of the top plate. In use, decking boards, which have a cut-out corresponding to the size and shape of the vertical tube, are fitted and locked in position around the elongate tube protrusion. The decking boards have two functions, namely to provide a flat surface for the desired application and to provide force translation through the boards, which enables the decking system to withstand greater loads. Such an arrangement also helps to achieve squareness of the decking boards and rigidity across the floor.

The connection hub may comprise a plurality of braces/struts. The braces/struts may be spaced around the elongate tube. The braces/struts may extend between the underside of base plate and the elongate tube. The braces may be angled. In particular, the braces may be angled between 30° and 60°. In some embodiments the braces may be angled between 40° and 50°. For example, the braces may be angled at 45°. The braces allow the generated loads to be distributed away from the connection hub and into the decking structure which allows for loadings of up to 184 kN per connection hub, which is much higher than normal loadings (~5 kN). The loads typically include dead loads, live loads, seismic loads and wind loads.

In addition to being insertable into a vertical support, the connection hub may be adapted to receive a vertical support which enables modular decking systems of increasing height to be built easily, quickly and with increased rigidity and strength. In some embodiments the vertical support may be a handrail stanchion.

The connection hub may comprise at least four formations for receiving reciprocating formations formed at the ends of the first and second horizontal supports. In some embodiments, the connection hub may comprise at least eight formations for reciprocating formations formed at the ends of the first and second horizontal supports. This enables decking beams to be installed at 45°, while allowing plan bars and braces to be attached to provide additional strength and rigidity to the decking structure.

The connection hub may comprise a female part and the ends of the first and second horizontal supports may each comprise a reciprocating male part for sliding engagement with the female part. In other embodiments the connection hub may comprise a male part and the ends of the first and second horizontal supports may each comprise a reciprocating female part for sliding engagement with the male part.

Irrespective of whether the male part is present at the ends of the horizontal supports or whether it projects radially outwards from the connection hub, the male part may have a circular cross-section, a diamond-shaped cross-section, a square-shaped cross-section or a rectangular-shaped cross-section when viewed in plan. The male part may be connected to the first and second horizontal supports or to the connection hub via a stem. The female part may have a substantially C-shaped cross-section when viewed in plan.

The male part or the female part of the connection hub may extend axially between the top plate and the base plate.

In some embodiments it may be desirable to erect a more permanent decking structure. Accordingly, the respective ends of the first and second horizontal supports may be secured to the connection hub by fastening means. The fastening means may comprise a bolted connection, in which case, the connection hub formations and the reciprocating formations located at the ends of the horizontal supports may comprise apertures for receiving the fastening means.

The first and third horizontal supports may each comprise means for fixing the third horizontal supports to the first horizontal supports. In particular, the first horizontal supports may be provided with U-shaped brackets which are adapted to receive a coupling part present at the ends of the third horizontal supports. In some embodiments, the end of the third horizontal supports may comprise an overhang portion from which the coupling part downwardly depends. The coupling part may be substantially J-shaped or hook-shaped. When a more permanent structure is desired, the U-shaped brackets may be provided with orifices and the ends of the third horizontal support may be provided with corresponding orifices which are configured to receive a bolt or other suitable fastening means therethrough, i.e. the orifices replace the overhang portions and J-shaped or hook-shaped coupling part.

A portion of each decking panel may be secured between the top plate of the connection hub and a decking panel retainer. In particular, each corner of the decking panel may be secured between the top plate and the decking panel retainer. The decking panel retainer may be circular. The decking panel retainer may additionally comprise a central hole or a cut out which allows a vertical support to be inserted into the connection hub.

A portion of each decking panel may be secured between a captivation details located on the top surface of the first horizontal support and a decking panel retainer. The captivation detail may have a substantially circular cross-section. The captivation detail may be positioned on the top surface of the first horizontal support between two U-shaped brackets. The captivation detail may be welded to the top surface of the first horizontal support.

Due to the increased loadings the modular decking system can withstand the modular decking is suitable for use as a structural building support. Accordingly, in some embodiments, the modular decking system may comprise a tower or column. The tower or column may be secured to two or more third horizontal supports. The third horizontal supports to which the tower or column are secured may be fixed to the first horizontal supports by a bolted connection. The modular decking system may therefore comprise third horizontal supports that are pinned/bolted to the first horizontal supports as well as third horizontal supports that comprise a coupling part that rotationally engages a bracket provided on the first horizontal support.

According to a second aspect of the invention there is provided a connector for a modular decking system, the connector comprising an elongate tube adapted for insertion into a vertical support and a connection hub that comprises formations that enables the connection hub to slidingly engage with reciprocating formations present at the ends of two or more horizontal supports.

The connector may be adapted for insertion into a vertical support of a scaffolding sub-structure. Advantageously the connector is insertable into a variety of scaffold systems selected from the group comprising Kwikstage, Cuplok, Scaffold Tube, Haki, Layher Ringlok, Alpac Ringlok, Futuro Ringlok, Metric Ringlok, Alround Ringlok, Turner+8 Co planer.

The connector may comprise a base plate on which the horizontal supports rest in use. The connection hub may be adapted to receive a vertical support member. The vertical support may comprise a handrail stanchion.

The connection hub may comprises a female part or a male part adapted for sliding interengagement with the respective ends of the horizontal supports. The male part or female part may extend axially between a top plate of the connection hub and the base plate.

The male part may have a circular cross-section, a diamond-shaped cross-section, a square-shaped cross-section or a rectangular-shaped cross-section when viewed in plan. The male part may be connected to the first and second horizontal supports or to the connection hub via a stem. The female part may have a substantially circular cross-section, a diamond-shaped cross-section, a square-shaped cross-section or a rectangular-shaped cross-section or C-shaped cross-section when viewed in plan.

The connection hub may comprise an aperture which is configured to receive a fastener for securing the connection hub and the respective ends of the horizontal supports together. The connection hub may comprise a plurality of apertures for receiving a corresponding number of fasteners. The fasteners may comprise a bolted connection, in which case the apertures are configured to receive an appropriately sized bolt which is retained in place by a nut.

According to a third aspect of the invention there is provided a method of assembling a modular decking system, the method comprising the steps of:

providing a plurality of vertical supports;

inserting a connector into each vertical support, wherein each connector comprises an elongate tube adapted for insertion into the vertical support and a connection hub adapted to enable interconnection of a first horizontal support and a second horizontal support;

interconnecting the first horizontal support and the second horizontal support to the connection hub through sliding interengagement;

fixing one or more third horizontal supports between a pair of parallel first horizontal supports to define a support frame, and securing one or more decking panels to the support frame.

The step of fixing the third horizontal support to the first horizontal support may comprise rotating the third or each third horizontal support relative to the first horizontal supports.

The method may comprise the additional step of securing the ends of the first and/or second horizontal supports to the connection hub using a bolted connection.

According to a fourth aspect of the invention there is provided a horizontal support adapted to rotationally engage with first horizontal supports of a modular decking system to secure the third horizontal support between the first horizontal supports.

The horizontal support according to the fourth aspect of the invention may incorporate any or all of the features described in relation to the modular decking system according to the first aspect of the invention and/or the method according to the third aspect of the invention.

DETAILED DESCRIPTION OF THE INVENTION

In order that the invention may be more clearly understood one or more embodiments thereof will now be described, by way of example only, with reference to the accompanying drawings, of which:

FIG. 1 shows an isometric view of a connector;

FIGS. 2A-2B respectively show plan and elevation views of first horizontal support;

Figure 5A:
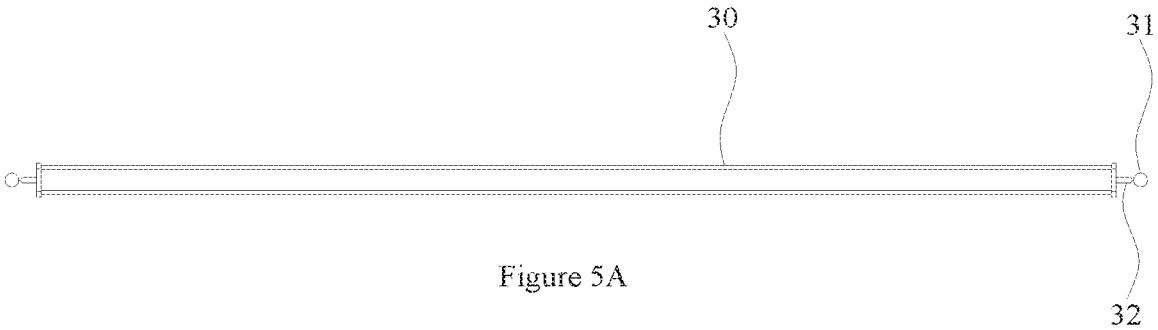
Figure 5B:
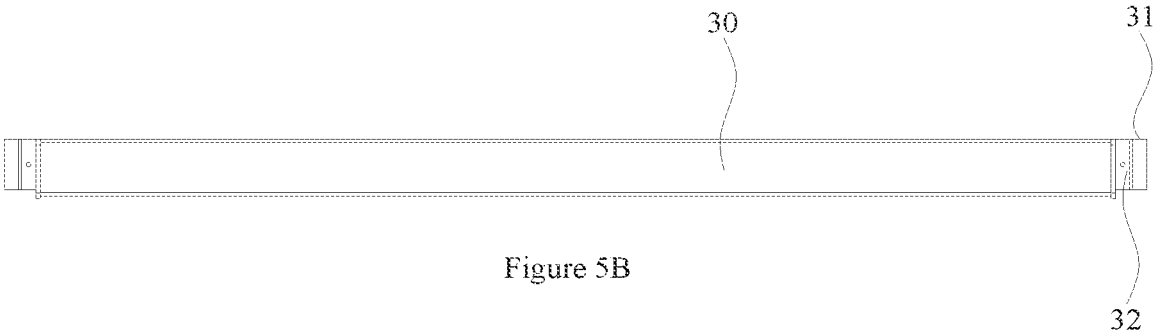
Figure 5C:
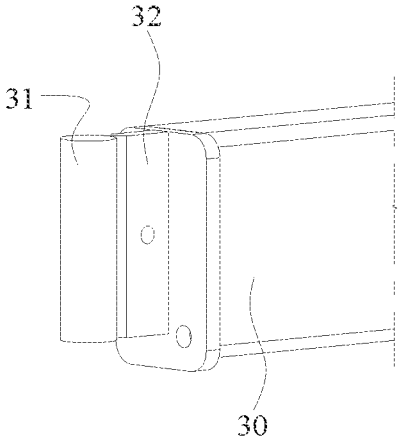
Figure 6:
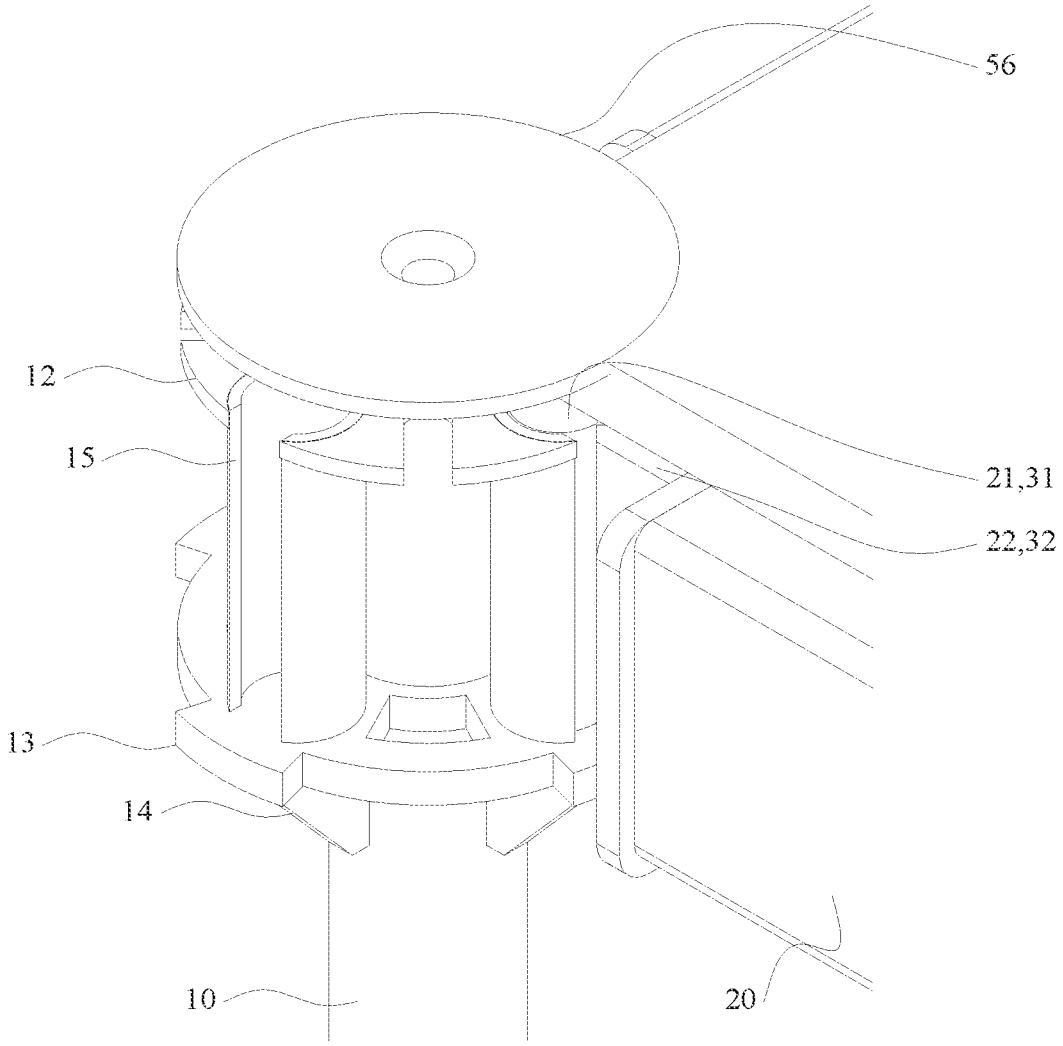
Figure 7:
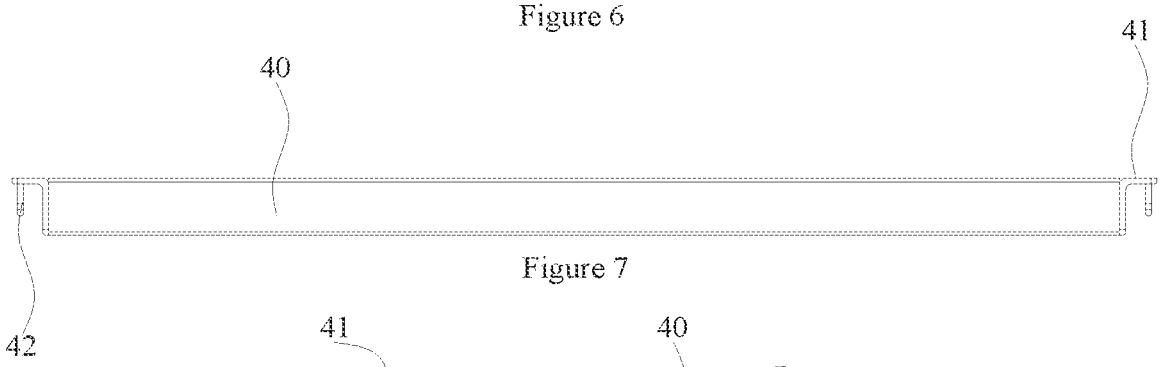
Figure 8:
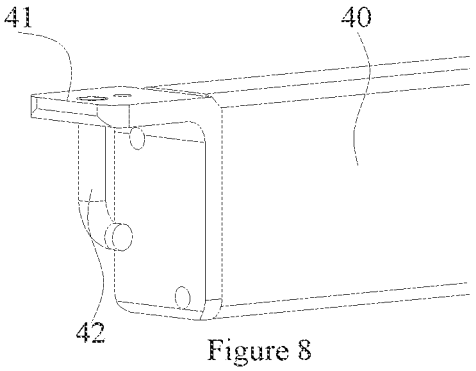
Figure 9:
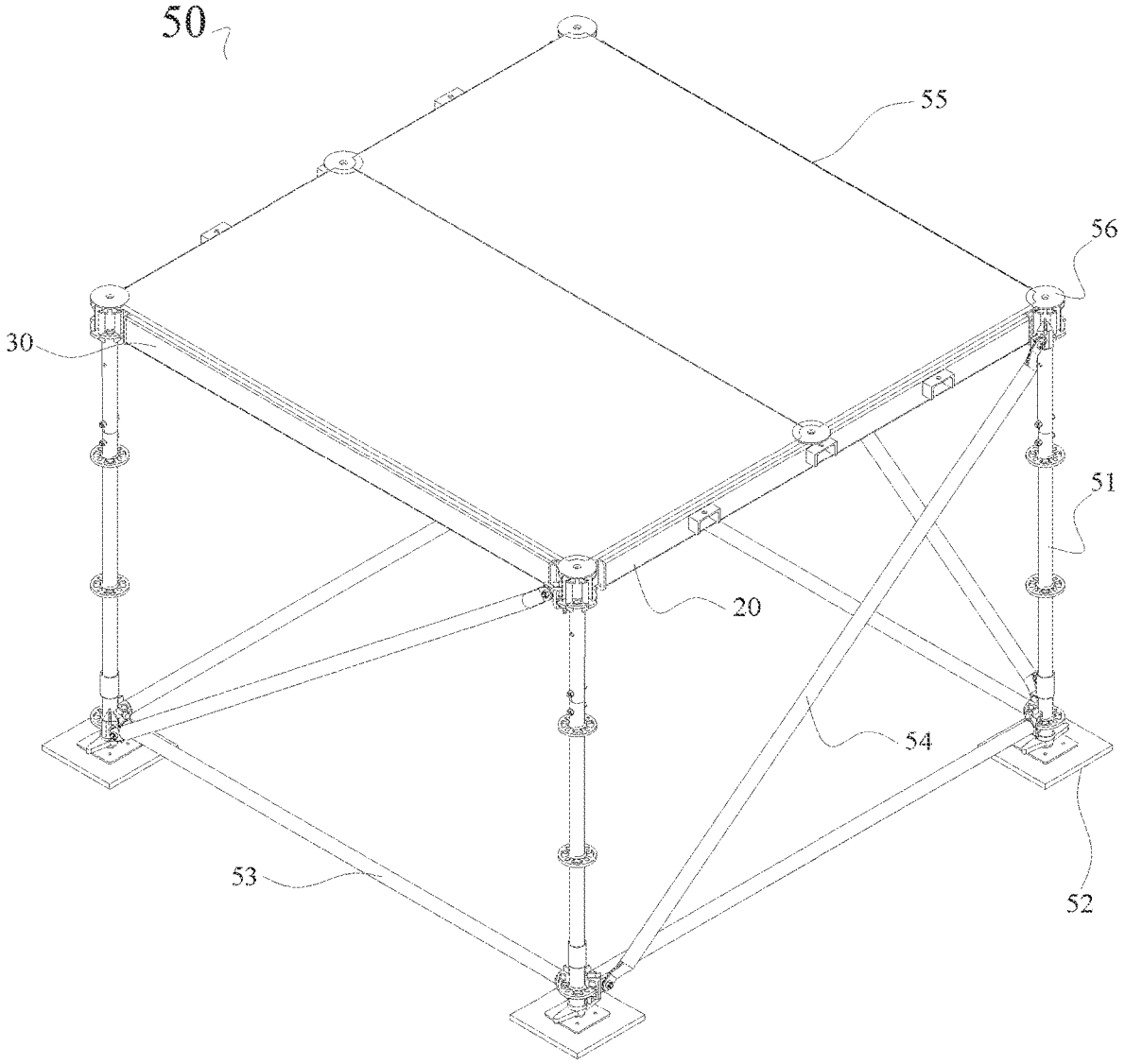
Figure 10:
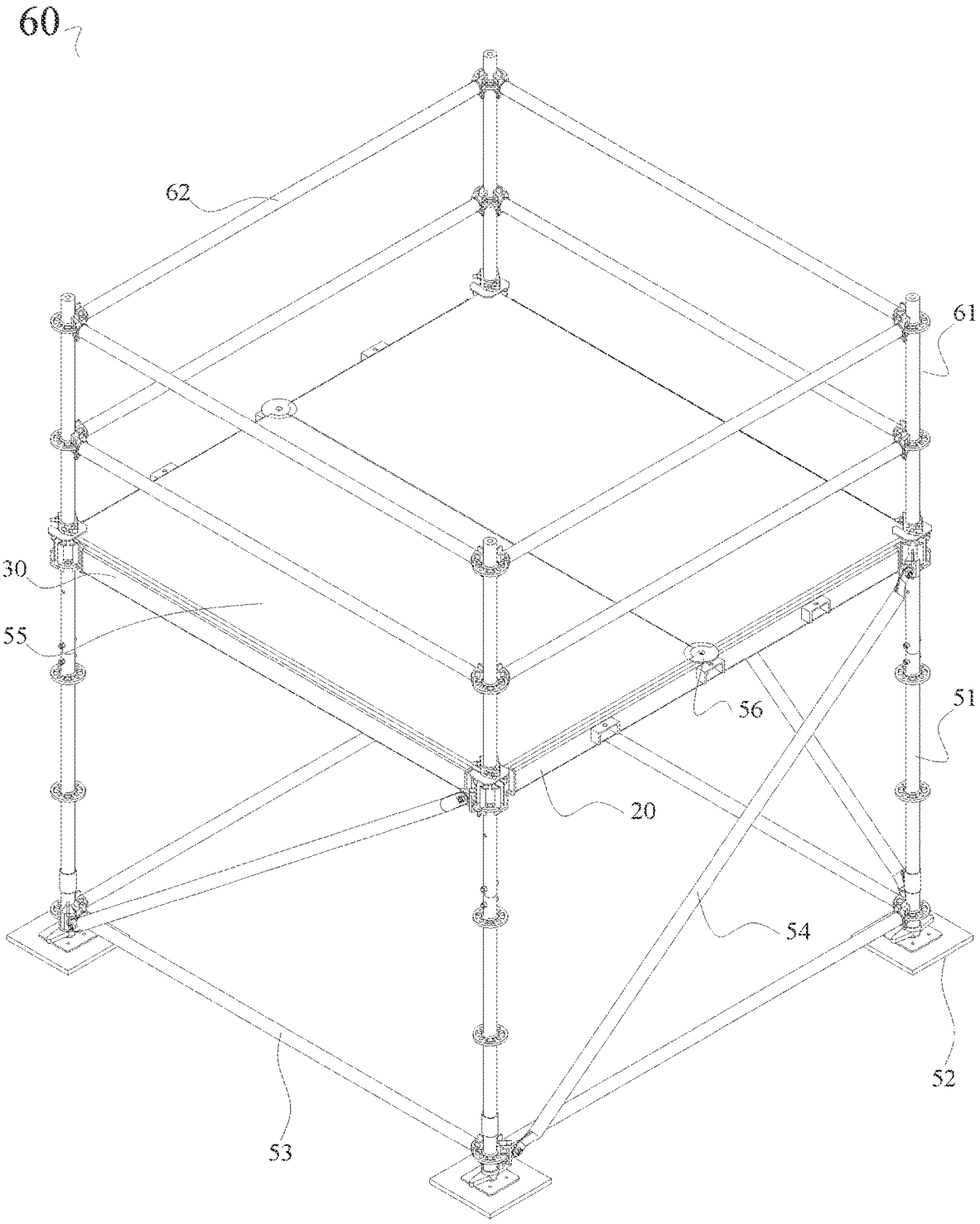
Figure 11:
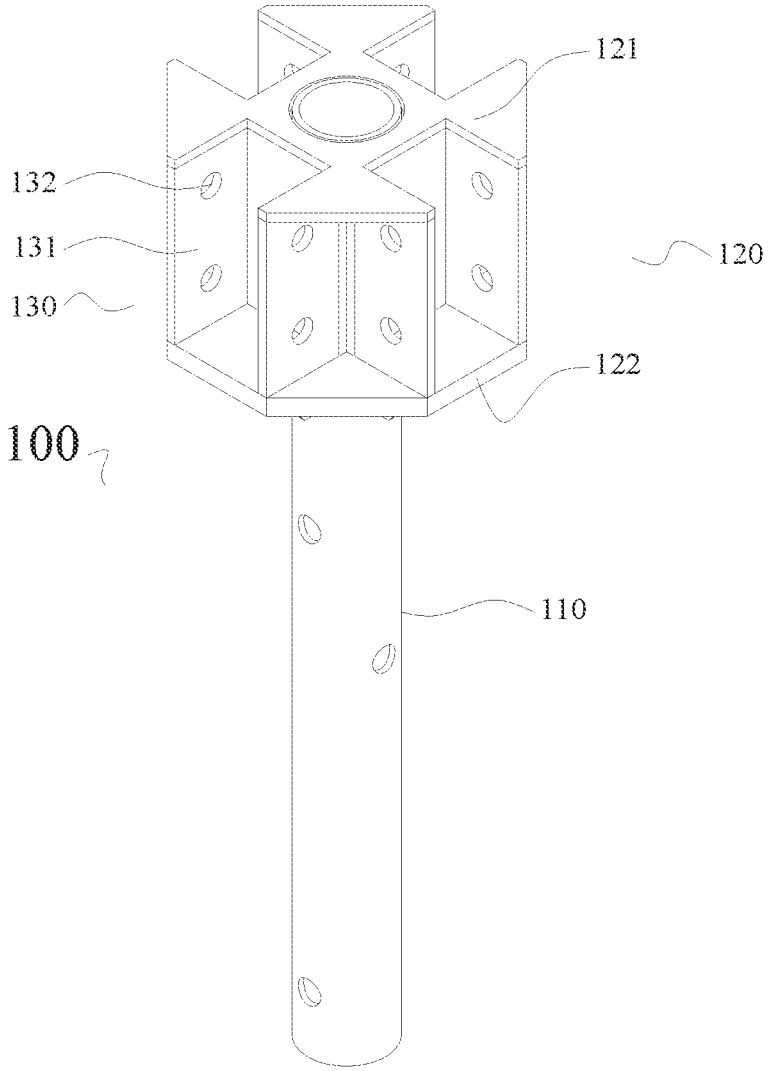
Figure 12A:
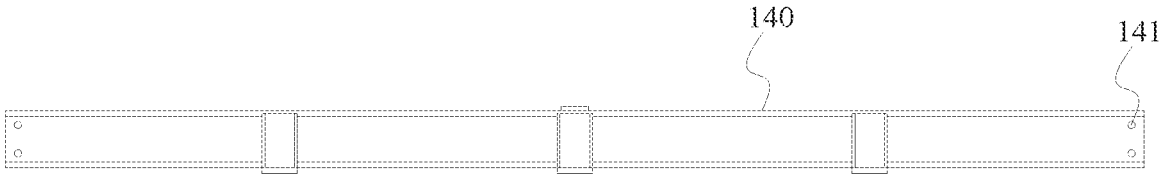
Figure 12B:
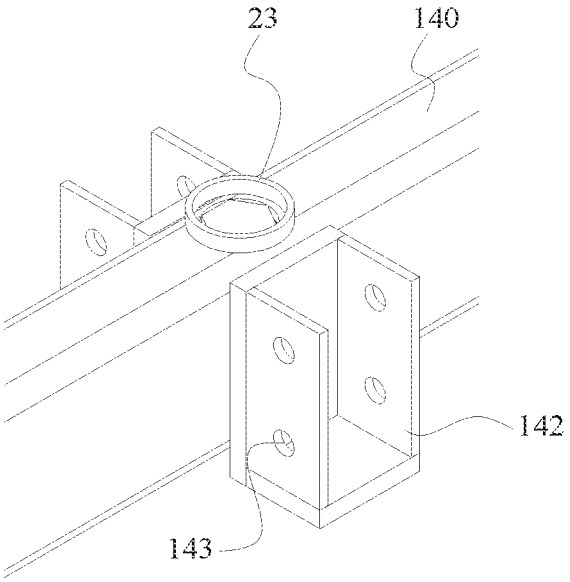
Figure 13:
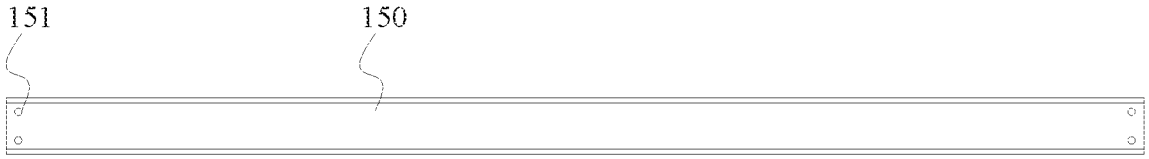

FIGS. 5A-5C respectively show plan, elevation and perspective views of a second horizontal support;

FIG. 6 shows an isometric view of a horizontal support retained in the connection hub;

FIG. 7 shows an elevation view of the third horizontal support;

FIG. 8 shows an end of the third horizontal support comprising an overhang portion and coupling part;

FIG. 9 shows an isometric view of a deck bay comprising modular decking system;

FIG. 10 shows an isometric view of the deck bay shown in FIG. 9 with a handrail;

FIG. 11 shows an isomeric view of connector for use in a more permanent modular decking system involving fasteners;

FIGS. 12A-12B respectively show elevation and perspective views of the first horizontal support for use in a more permanent decking system involving fasteners;

FIG. 13 shows an elevation view of a second horizontal support for use in a more permanent decking system involving fasteners.

Figure 14:
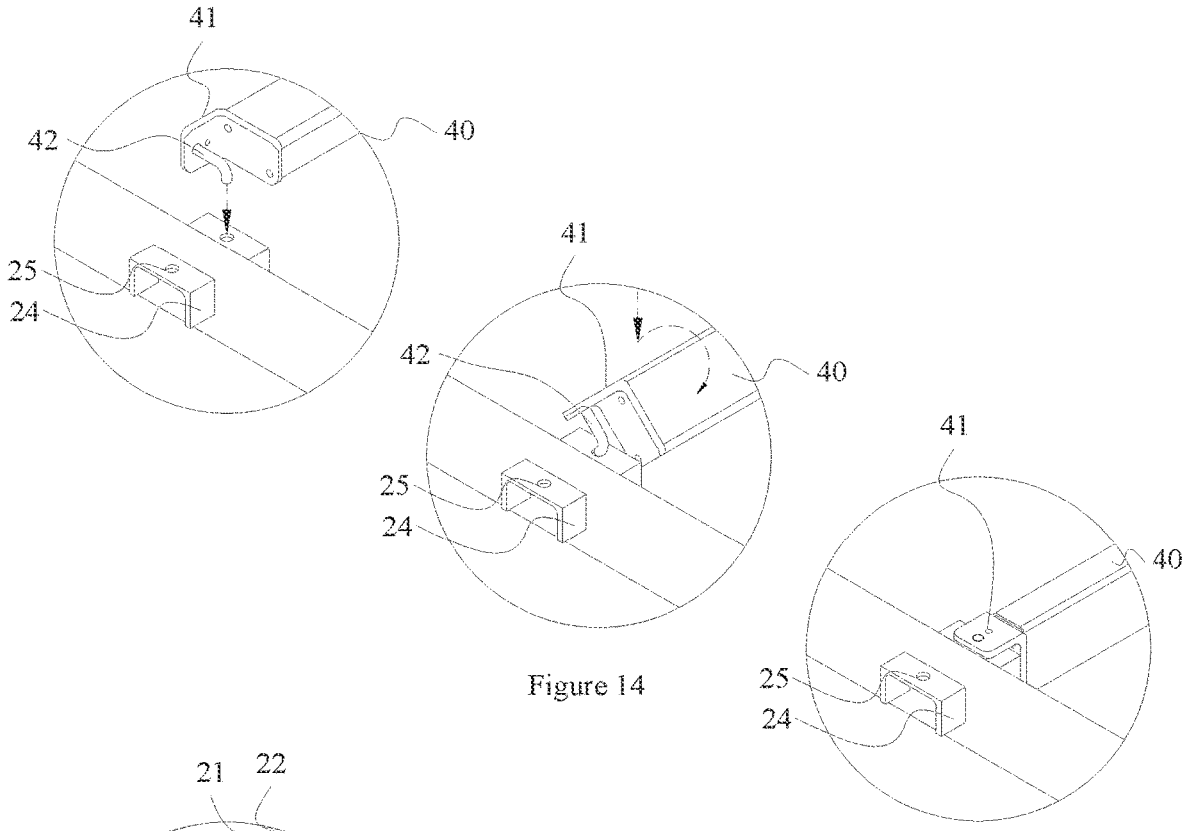
Figure 15:
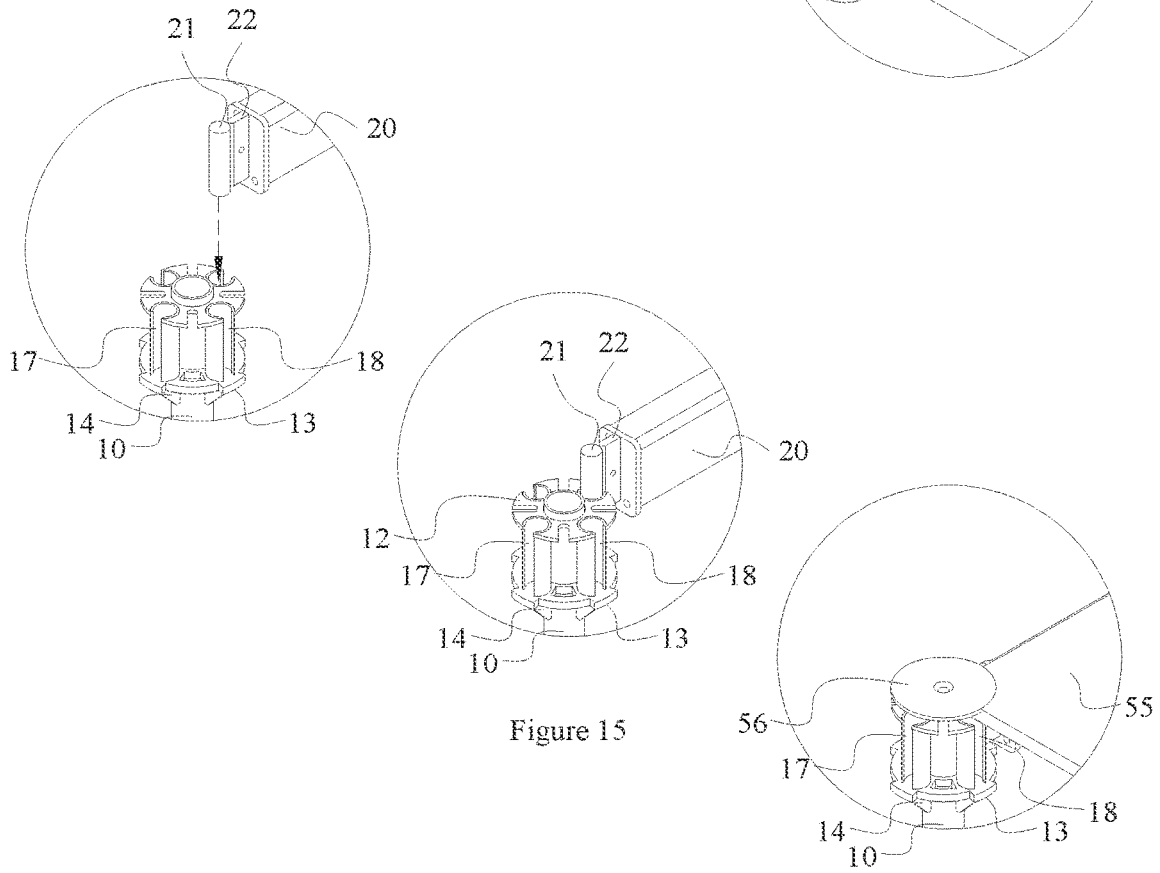

FIG. 14 shows a method of securing a first horizontal support to the connection hub, and FIG. 15 shows a method of securing a third horizontal support to a first horizontal support.

Figure 1:
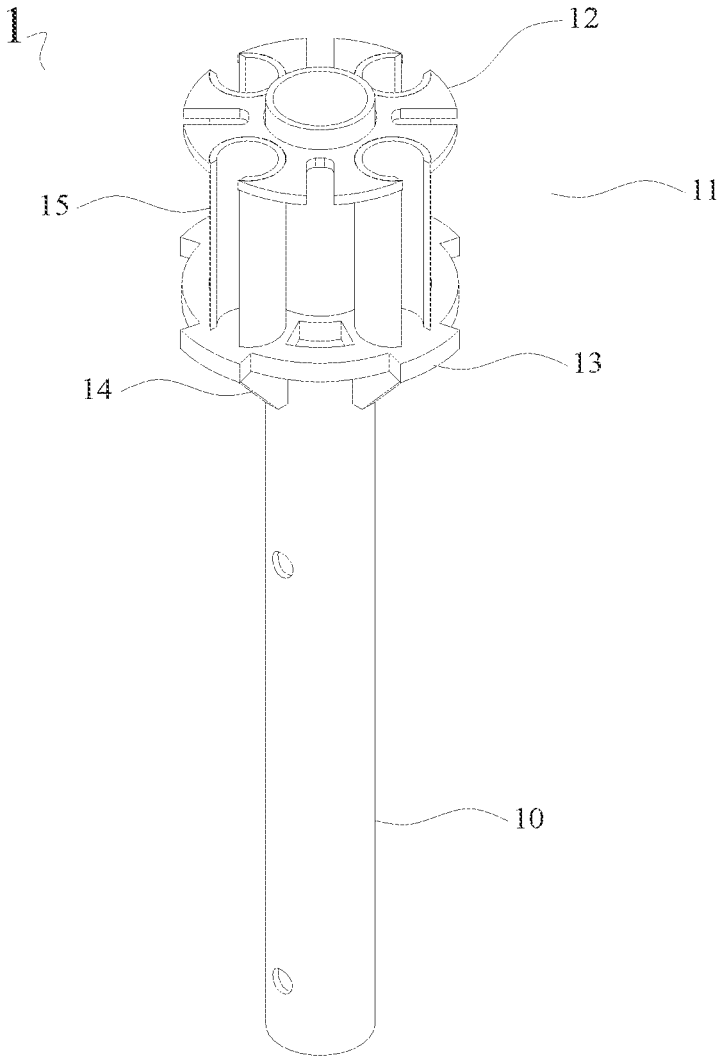

As shown in FIG. 1 there is provided a connector 1 for a modular decking system. The connector 1 comprises an elongate tube 10 having a head portion and a tail portion. The head portion of the connector comprises a connection hub 11. The connection hub comprises a top plate 12 and a base plate 13 which is supported by a plurality of braces/struts 14. The braces/struts 14 are provided between the underside of the base plate and the vertical tube at an angle of 45°. The elongate tube 10 extends through and protrudes beyond the top plate 12. The connection hub 11 also comprises a plurality of formations 15 which are arranged around the periphery of the elongate tube 10 and extend axially between the top plate 12 and the base plate 13. As best shown in FIG. 1 the top plate 12 is adapted to accommodate the formations 15 and comprises correspondingly shaped cut outs. Examples of connection hub formations are shown in FIGS. 4A-4D. For instance, the connection hub formations may be substantially tubular (female part) substantially diamond-shaped (female part), rectangular (female part) or T-shaped (male part).

The connection hub formations 15 in this embodiment are configured to slidingly engage with reciprocating formations present at the ends of a first horizontal beam 20 and a second horizontal beam 30. Exemplary reciprocating formations 21, 31 are shown in FIGS. 4A-4D. In this embodiment the connection hub formation 15 comprises a hollow tube 17 with a gap 18 which extends axially from one end of the tube to the other. The reciprocating formation 21, 31 is in the form of a solid cylinder which it dimensioned to fit within the interior of the hollow tube 17. The cylinder 21, 31 is connected to the first and second horizontal beams 20, 30 via a stem 22, 32 and the stem 22, 32 is configured to slide along the axial gap 18 formed in the wall of the hollow tube 17 until the base of the cylinder 21, 31 abuts the base plate 15 of the connection hub 11.

Figure 2A:
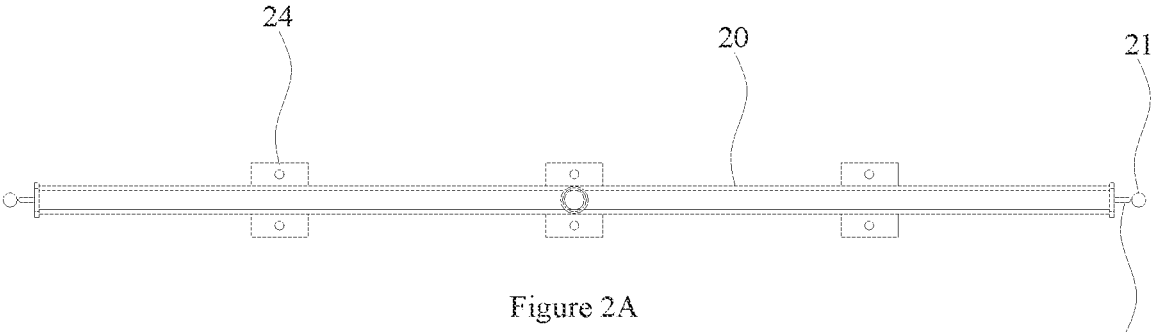
Figure 2B:
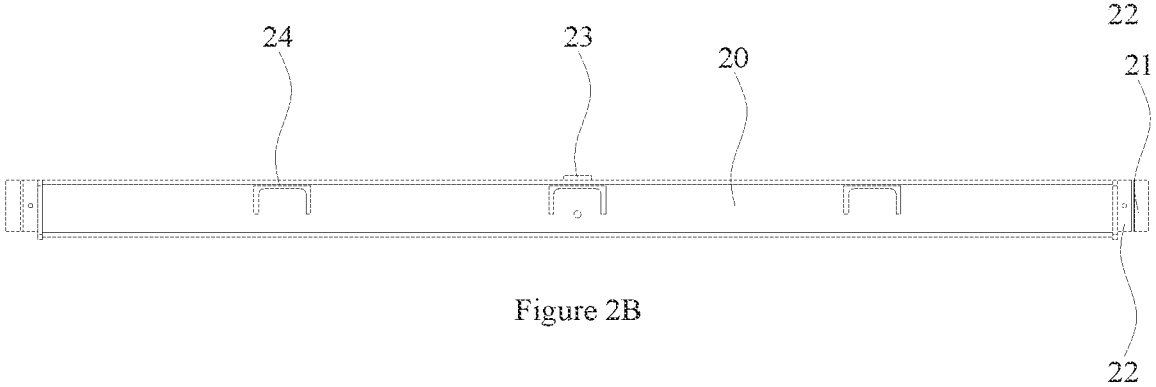
Figure 3:
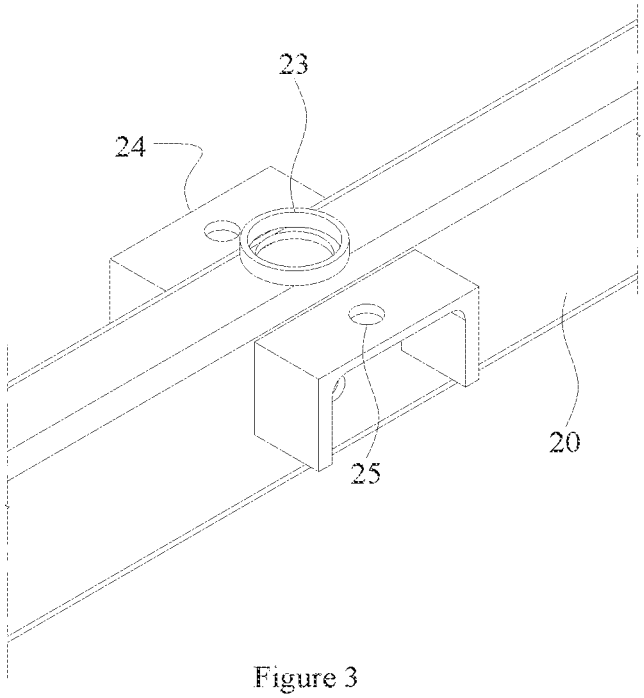
FIG. 3 shows a perspective view of the first horizontal support shown in FIG. 2
Figure 4A:
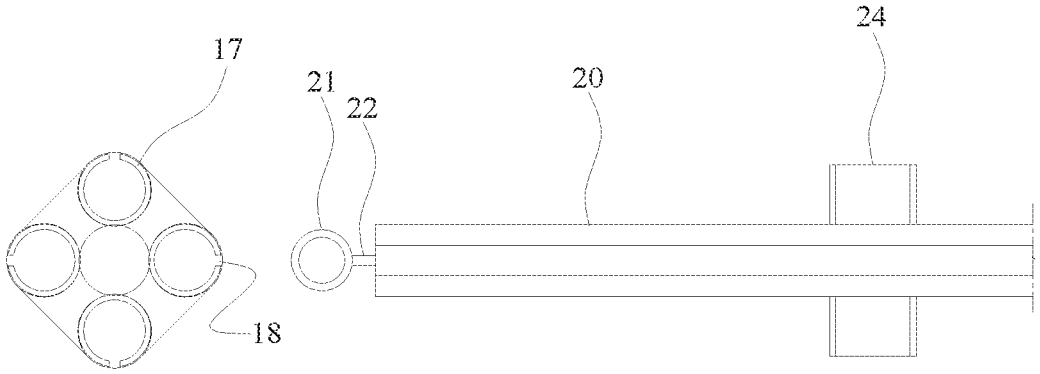
FIGS. 4A-4D show plan views of reciprocating formations for the connection hub and the first horizontal support.
Figure 4B:
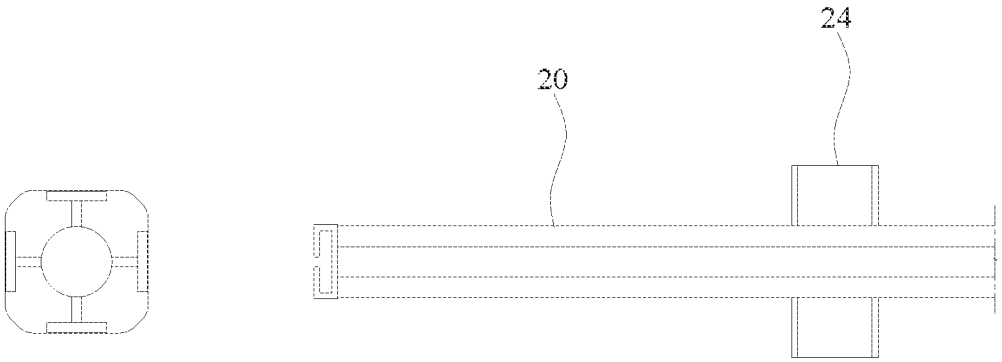
Figure 4C:
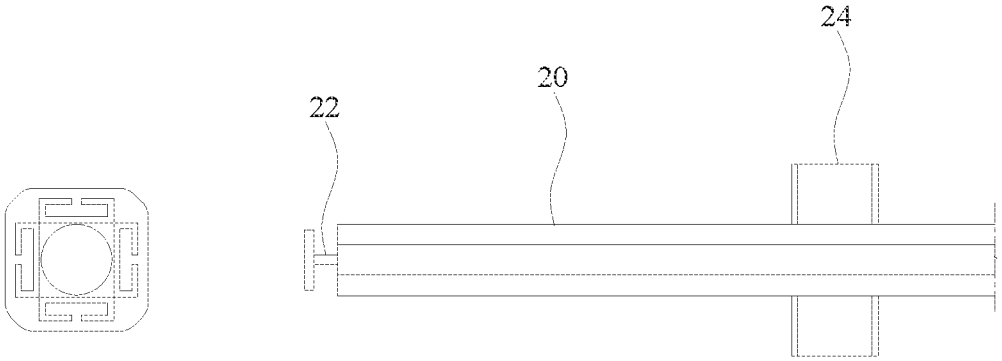
Figure 4D:
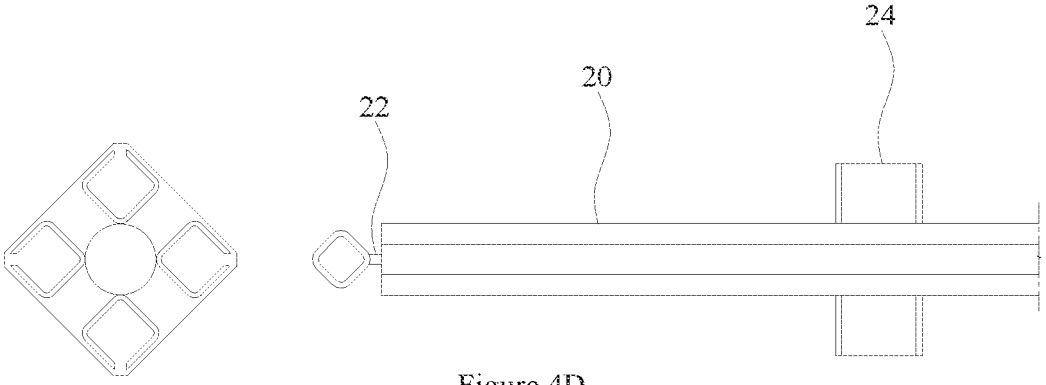

As best shown in FIGS. 2 and 3, the first horizontal beam 20 comprises a circular captivation detail 23 for retaining a decking board in use. The captivation detail 23 is welded to the top surface of the first horizontal beam 20. On either side of the first horizontal beam 20 there is provided a pair of spaced apart brackets 24. Each bracket pair is substantially aligned with a respective captivation detail 23. The brackets 24 are substantially U-shaped and comprise an aperture 25 in the bridging section spanning the two legs.

FIGS. 7 and 8 show a third horizontal beam 40. Each end the third horizontal beam 40 comprises an overhang portion 41 which extends axially outwards from the third horizontal beam 40. As best shown in FIG. 8, a J-shaped appendage 42 is attached to the underside of the overhang portion 41. The J-shaped appendage 42 is configured for insertion into the bracket aperture 25, and in use helps secure the third horizontal beam 40 to the first horizontal beam 20.

FIG. 9 shows a deck bay 50 formed from the modular decking system. The deck bay 50 comprises a scaffolding sub-structure which includes four vertical tubes 51. The lowermost end of each vertical tube is connected to a scaffold base plate 52 via a shank which extends upwardly from the centre of the base plate into the interior of the vertical tube 51. Four horizontal tubes 53 are connected to the lower ends of the vertical tubes via couplers. The scaffolding sub-structure additionally comprises four cross-braces 54. Each cross brace extends diagonally from a lower end of one vertical tube 51 to an upper end of and adjacent vertical tube 51.

The tail end of the connector 1 is inserted into the upper end of vertical tube 51. As best shown in FIG. 9, the first and second horizontal beams 20, 30 extend between the connectors 1. The third horizontal beams 40 extend between the first horizontal beams 20. As best shown in FIG. 15, to connect the first horizontal beam 20 to the connector 1, one end of the first horizontal beam 20 is positioned above the connection hub 11. Then the cylinder 21 is brought into alignment with the hollow tube 17 of the connection hub 11 while also ensuring that the stem 22 is suitably aligned with the gap 18. Once aligned, the cylinder 21 is lowered into the hollow tube 17 until it abuts the base plate 13 of the connection hub 11. This process is then repeated to secure the cylinder 21 at the opposite end of the first horizontal beam 20 within a hollow tube 17 of an adjacent connection hub 11. The same process of sliding engagement is repeated to secure the second horizontal beams 20 between adjacent connection hubs 11. Advantageously, securing the first and second beams 20, 30 to the connection hub 11 by sliding engagement avoids the need for pins, bolts and tools.

Next, the third horizontal beams 40 are secured between the first horizontal beams 20 (FIG. 14). This is achieved by inserting the free end of the J-shaped appendage 42 into the aperture 25 formed in the U-shaped bracket 24. In particular, the J-shaped appendage 42 is rotated into place as the third horizontal beam 40 is lowered into position. This not only secures the beams 20, 40 together, it also prevents the first horizontal beam 20 from rotating which gives it more strength and allows it to be of a lighter gauge.

As best shown in FIG. 10, the decking bay may comprise handrails 60. If desired, handrail stanchions 61 are inserted into the head portion of the elongate tube 10 and horizontal handrail tubes 62 are arranged between and secured to the handrail stanchions by couplers. Decking panels 55 are then arranged to overlie the connection hub 11 and the captivation details 23 on the first horizontal beams 20. If the decking bay 50 comprises handrail stanchions 61 then the decking panels 55 may be secured to the connection hub 11 using a decking panel clamp which is connected to the handrail stanchion 61. In the absence of handrail stanchions 61, the corners of the decking panel 55 may be secured to connection hub 11 using a decking panel retainer 56. Decking panel retainers 56 are nevertheless used to secure the decking panels 56 to the top surface of the first horizontal beams 20 and as shown in FIGS. 9 and 10 these overlie the captivation details 23.

In alternative embodiments a more permanent modular decking system may be erected. Such systems may comprise the connector 100 shown in FIG. 11 which comprises an elongate tube 110 adapted for insertion into a vertical support and a connection hub 120 having a base plate 121 and a top plate 122. This connection hub 120 comprises formations 130 which are shaped to receive the ends of the first and second horizontal beams 140, 150 rather than a connection detail extending therefrom as in the previous embodiment described hereinabove. As shown in FIG. 11-13, the walls 131 of the formations 130 comprise holes 132 and the ends of the first and second horizontal beams 140, 150 also comprise holes 141, 151 which are arranged for receiving fastening means such as bolts.

In this embodiment, the second horizontal beams 150 extend between adjacent connection hubs 120 and between the first horizontal beams 140, i.e. they replace the third horizontal beams 40. To secure the second horizontal beams 150 between the first horizontal beams 140 each leg of the U-shaped bracket 142 is adapted to comprise holes 143 for receiving fastening means such as a bolt from a bolted connection. As best shown in FIG. 12B, the U-shaped bracket 142 in this embodiment is also inverted relative to the U-shaped bracket 24 of the previously described embodiment.

To erect the more permanent modular decking system, the ends of the first and second horizontal beams 140, 150 are positioned above the connection hub 120. They are then lowered until the ends contact the base plate 122 of the connection hub 120. Bolts are then fed through the holes 132 formed into the walls 131 of the formations 130 and also through the holes 141, 151 formed in the first and second beams 140, 150 respectively. The bolts are retained in place using nuts. Second horizontal beams 150 are then lowered into the U-shaped brackets 142 and these are secured in place by feeding bolts through the holes 143 in the U-shaped brackets 142 and the second horizontal beams 151. Nuts are again used to retain the bolts in place. Decking panels 55 are then secured in place in the same manner as described for the previous embodiment.

The one or more embodiments are described above by way of example only. Many variations are possible without departing from the scope of protection afforded by the appended claims.

The invention claimed is:

1. A modular decking system comprising:

a decking panel;

a plurality of vertical supports;

at least two first horizontal supports;

at least two second horizontal supports arranged perpendicular to the first horizontal supports, one or more third horizontal supports arranged between the first horizontal supports and parallel to the second horizontal supports, and a plurality of connectors for detachably coupling the first and second horizontal supports, the connectors comprising a connection hub having a base plate and a top plate and an elongate tube adapted for insertion into the vertical supports which protrudes beyond the top plate, wherein the connection hub and the ends of the first and second horizontal supports comprise reciprocating formations to enable the respective ends of the first and second horizontal supports to slidingly engage with the connection hub; and wherein the connectors comprise a plurality of struts that extend between an underside of the base plate and the elongate tube.

2. The modular decking system according to claim 1, wherein the connection hub comprises a female part and the ends of the first and second horizontal supports each comprise a complementary male part for sliding engagement with the female part or wherein the connection hub comprises a male part and the ends of the first and second horizontal supports each comprise a complementary female part for sliding engagement with the male part.

3. The modular decking system according to claim 2, wherein the male part or the female part of the connection hub extends between the top plate and the base plate.

4. The modular decking system according to claim 3, wherein the male part has a circular cross-section, a diamond-shaped cross-section, a square-shaped cross-section or a rectangular-shaped cross-section when viewed in plan.

5. The modular decking system according to claim 1, wherein the respective ends of the first and second horizontal supports are secured to the connection hub by fastening means.

6. The modular decking system according to claim 1, wherein the first horizontal supports are provided with U-shaped brackets which are adapted to receive a coupling part present at the ends of the third horizontal supports.

7. The modular decking system according to claim 6 wherein the ends of the third horizontal supports comprise an overhang portion from which the coupling part downwardly depends.

8. The modular decking system according to claim 6, wherein the coupling part is substantially J-shaped or hook-shaped.

9. The modular decking system according to claim 1, wherein a portion of each decking panel is secured between the top plate of the connection hub and a decking panel retainer.

10. The modular decking system according to claim 1, wherein a tower is secured to two or more third horizontal supports and wherein the third horizontal supports to which the tower is secured are fixed to the first horizontal supports by a bolted connection.

11. A connector for a modular decking system, the connector comprising an elongate tube adapted for insertion into a vertical support and a connection hub that comprises formations that enables the connection hub to slidingly engage with reciprocating formations present at the ends of two or more horizontal supports, wherein the connection hub comprises a top plate beyond which the elongate tube protrudes and a base plate on which the horizontal supports rest in use; and wherein the connection hub comprises a plurality of struts that extend between an underside of the base plate and the elongate tube.

12. The connector according to claim 11, wherein the connection hub is adapted to receive a vertical support member.

13. The connector according to claim 11, wherein the connection hub comprises a female part or a male part adapted for sliding interengagement with the respective ends of the horizontal supports.

14. The connector according to claim 13, wherein the male part or female part extends between a top plate of the connection hub and the base plate.

15. The connector according to claim 11, wherein the connection hub comprises an aperture which is configured to receive a fastener for securing the connection hub and the respective ends of the horizontal supports together.

* * * * *